US008434175B1

(12) United States Patent
Wright et al.

(10) Patent No.: US 8,434,175 B1
(45) Date of Patent: May 7, 2013

(54) NONWOVEN FABRICS FOR BEDDING APPLICATIONS

(75) Inventors: Christopher Wright, Guntersville, AL (US); Christopher Resha, Arab, AL (US)

(73) Assignee: SS Imports, Inc., Guntersville, AL (US)

( * ) Notice: Subject to any disclaimer, the term of this patent is extended or adjusted under 35 U.S.C. 154(b) by 0 days.

(21) Appl. No.: 12/539,179

(22) Filed: Aug. 11, 2009

Related U.S. Application Data

(66) Substitute for application No. 61/087,865, filed on Aug. 11, 2008.

(51) Int. Cl.
*A47C 31/00* (2006.01)

(52) U.S. Cl.
USPC ..... 5/500; 5/499; 5/502

(58) Field of Classification Search ..... 5/482, 483, 5/484, 487, 490, 495, 496, 497, 499, 500, 5/502
See application file for complete search history.

(56) References Cited

U.S. PATENT DOCUMENTS 4,704,753 A * 11/1987 Lunt ..... 5/484
4,886,697 A * 12/1989 Perdelwitz et al. ..... 428/192
5,050,256 A 9/1991 Woodcock
5,409,761 A 4/1995 Langley
5,560,974 A 10/1996 Langley
5,662,978 A 9/1997 Brown et al.
5,698,481 A 12/1997 Van Hout et al.
5,814,390 A 9/1998 Stokes et al.
5,950,264 A 9/1999 Wyner et al.
6,171,689 B1 1/2001 Kaytor et al.
6,253,398 B1 * 7/2001 Yim ..... 5/499
6,569,136 B1 * 5/2003 Tao et al. ..... 604/385.01
6,610,383 B1 8/2003 Morman et al.
6,649,251 B1 11/2003 Druecke et al.
6,821,915 B2 11/2004 Morman et al.
7,370,380 B2 * 5/2008 DeFranks et al. ..... 5/691
2002/0019187 A1 2/2002 Carroll et al.
2002/0033562 A1 3/2002 Kauschke et al.
2002/0148047 A1 * 10/2002 Corzani et al. ..... 5/738
2003/0199217 A1 10/2003 Cashin et al.
2003/0207640 A1 11/2003 Anderson et al.
2004/0063371 A1 4/2004 Cox et al.
2005/0250401 A1 11/2005 Baba
2006/0019064 A1 1/2006 McDonald
2006/0089073 A1 4/2006 Sobieski

* cited by examiner

*Primary Examiner* — Robert G Santos
*Assistant Examiner* — Nicholas Polito
(74) *Attorney, Agent, or Firm* — Maynard Cooper & Cale, P.C.; Jon E. Holland

(57) ABSTRACT

Protective covers for pillows and mattress are wholly or partly made of layered polyolefin fabrics. The layered polyolefin fabrics used for the protective covers are sheets of material bonded together with an adhesive or other bonding methods. One of the layers of the laminated fabric is a nonwoven polyolefin fabric and another layer is a polyolefin film. The protective covers stop migration of dust mites and are also reusable. The covers are cleaned and sanitized using a washer and a dryer.

14 Claims, 5 Drawing Sheets

NONWOVEN FABRICS FOR BEDDING APPLICATIONS

CROSS REFERENCE TO RELATED APPLICATION

This application claims priority to U.S. Provisional Application No. 61/087,865, entitled "Non-Woven Fabrics for Bedding Applications," and filed on Aug. 11, 2008, which is incorporated herein by reference.

FIELD OF THE INVENTION

The present disclosure generally relates to the field of bedding protection covers that provide a protection barrier for bedding elements, such as mattress covers and pillow covers.

BACKGROUND

A protective cover for a bedding element, such as a mattress or a pillow, is often used as a dust barrier between the bedding element and a person resting on the element. In some cases, allergenic health problems are caused if the material used as the dust barrier is too porous, thereby allowing dust created by dust mites to enter the personal space or breathing area of the person resting on the bedding element. In general, conventional protective covers are available for reducing allergenic health problems associated with dust mites. One such conventional protective cover, made of a relatively inexpensive thermal plastic, such as polyvinyl chloride, is considered to be a disposable cover. However, such a disposable protective cover is often noisy and uncomfortable and is expensive over time if replaced frequently. Finely woven fabrics, such as cottons or polycottons, with a sufficiently high thread count are also used to make a conventional protective cover. The protective cover of finely woven fabric provides a good allergen barrier, but such a protective cover is expensive and sometimes shrinks after numerous wash/dry cycles. Hence, there is a need for a protective fabric that is less expensive than finely woven fabrics and is more durable than other fabrics used for protective covers. Often fabrics that may appear to be useful for making protective covers have characteristics unsuitable for such a use.

In addition to protection from dust mites and their fecal matter, there are other uses for protective covers. Other pests such as fleas, bed bugs and the like often become a health problem or a nuisance. Protective covers for bedding elements are generally desired to significantly reduce many of the health problems and irritations associated with insects and dust.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION

Figure 1:
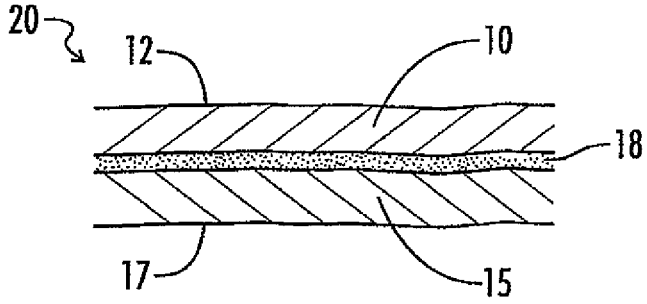
FIG. 1 depicts an exemplary embodiment of a layered polyolefin fabric for protective covers.

The present disclosure generally pertains to protective covers that encase bedding elements and provide a barrier for the bedding elements. The barrier prevents the transfer of harmful matter, such as dust and dust mites, so that allergenic and other health problems associated by breathing the dust are reduced. In one exemplary embodiment, the protective cover has a cavity that is defined by interior surfaces of panels comprising the protective cover. A panel is a sheet of material shaped to conform to a respective bedding element. Bedding elements include, for example, mattresses, pillows, cushions and box springs. The protective covers comprise panels of polyolefin materials arranged in a layered structure. The polyolefin materials, when arranged and joined in a laminated arrangement, have sufficient strength and shrinkage properties that make the protective cover launderable and reusable. In this regard, the protective covers can be cleaned and sanitized using a conventional washer and dryer, i.e., the cover can survive numerous wash/dry cycles without significant degradation. It is generally accepted by those in the bedding and clothing industry that polyolefin fabrics are one time use fabrics. For example, protective clothing, made of polyolefin fabric, is usually discarded after being worn for one day.

In one exemplary embodiment, a protective bedding cover is composed of laminated polyolefin fabric (LPF), which significantly limits and/or prohibits the passage of various particles, such as dust, dust mites, and bed bugs. The protective cover has a size and shape adapted to receive a respective bedding element. For example, a protective cover for a mattress has a size and shape for encasing a mattress.

In one exemplary embodiment, an opening in the protective cover is provided for inserting the bedding element into the cover or for removing the bedding element from the cover. The opening has a closure that holds the bedding element within the protective cover when the closure is in a closed position. The closure is a zipper or one of many closures, such as, for example, a hook loop fastener, one or more snaps, a ziplock closure, pressure sensitive adhesive (psa), or other closure known to those in the bedding industry. The LPF has properties compatible with techniques for joining conventional fabrics of the bedding industry. For example, the LPF of the disclosure may be sewn together using a sewing machine typically found in a factory that manufactures bedding products.

Polyolefin materials are well known to those in the thermal plastic industry and therefore will not be discussed in detail. A polyolefin is a polymer produced from a simple olefin (a well known compound). Members of the polyolefin material family include, for example, polypropylene and polyethylene. Polyolefin materials are often used to form nonwoven fabrics and films.

Although nonwoven fabric manufacturing is well known, a brief description is provided herein in order to provide a better understanding of the present disclosure. In general, nonwoven fabrics are broadly defined as sheet or web structures bonded together by random laying or entangling fibers or filaments mechanically, thermally or chemically. Nonwoven fabrics are flat, porous sheets that are made directly from separate fibers or from molten plastic or plastic film. When a nonwoven fabric is made of a polyolefin, then the nonwoven fabric is called a nonwoven polyolefin fabric. For the present disclosure nonwoven polyolefin fabrics include, but are not limited to, nonwoven polypropylene, nonwoven polyester, nonwoven polyethylene, SMS fabric (Spun Bond, Meltblown, Spun Bond) polyproplene, SMMS (Spun Bond, Meltblown, Meltblown, Spun Bond) polyproplene, or combinations thereof.

A polyolefin film is a thin layer (a sheet) of a polyolefin. A polyolefin film is composed of polypropylene, polyethylene, polyester, polyurethane, or polyacrylic or combinations thereof. A polyolefin film may be breathable or nonbreathable and may be microporous or nonporous. Nonwoven polyolefin fabrics are laminated with polyolefin films to form laminates. A variety of well known bonding methods can be used to make the laminates of the polyolefin materials. Such bonding methods are also suitable for bonding polyolefin materials to other material.

An embodiment of a laminated polyolefin fabric (LPF) that is used for panels of a protective cover is depicted in FIG. 1. The embodiment depicted in FIG. 1 is a bi-laminate fabric 20 composed of a nonwoven polyolefin fabric 10 and a polyolefin film 15. The nonwoven fabric 10 is bonded to (e.g., laminated with) the polyolefin film 15 using an adhesive 18. In other embodiments, other methods of bonding the nonwoven fabric 10 to the polyolefin film 17 can be used. The LPF of FIG. 1 has one surface that is a nonwoven surface 12 and another surface that is a film surface 17.

The LPF 20 of FIG. 1 has properties suitable for use as a protective cover. The LPF 20 is created to have strength properties for durability and shield properties to obstruct the movement of dust and dust mites. In addition, the LPF 20 has sufficient resistance to shrinkage caused by numerous wash/dry cycles. In one exemplary embodiment, after multiple wash/dry cycles, the shrinkage of the LPF 20 is about 3% and the fabric maintains its integrity for continued use as a protective cover. In addition, the LPF 20 is relatively inexpensive compared to conventional protection fabrics. Although it is generally accepted that products, such as protective clothing and gowns, made of polyolefin fabrics are discarded after one use, the results of durability tests for the LPF 20 show that it is reusable after multiple wash/dry cycles.

Table 1 below shows various parameters of embodiments of the LPFs depicted in FIG. 1 and FIG. 2. The nonwoven polyolefin fabric 10 is a spun-bonded polypropylene fabric having a total weight ranging from approximately 12 to 50 grams per square meter (gsm), and the polyolefin film 15 is a polyethylene film having a total weight ranging from approximately 10 to 50 gsm. The nonwoven fabric and film are bonded together with an adhesive of weight ranging from approximately 3 to 18 gsm (when adhesive is necessary). The various test methods are well known and determine if a fabric satisfies the specific parameters listed in Table 1

TABLE 1

Parameters for a suitable Bilaminate or Trilaminate LPF

| Parameter | Units | Approximate Value | Test Method |
|---|---|---|---|
| Basic Weight | gsm (grams per sq. meter) | 25 to 118 | ASTM D751 |
| MD Tensile Strength | Lbs.(2 inch strip method) | 10 minimum | ASTM D5034 |
| CD Tensile Strength | Lbs.(2 inch strip method) | 10 minimum | ASTM D5034 |
| MVTR (moisture vapor hours transfer rate) | Grams/sqmeter/24 | 0 to 400 | ASTM E96 (method B) |
| Shrinkage Ratio | Percent (%) | 3 to 5 maximum in any direction | AATCC 135 (3 cycles minimum - cold wash low heat dry) |
| Resistance to abrasion (pilling) | Category | 3 minimum | ASTM D3512 |
| Liquid Penetration | Pass/Fail | Pass | ASTM F903-99 |
| Allergen Barrier | Micron | <2 up to 10 (pass) | ASTM E1294 |

The tensile strengths in Table 1 are related to the durability of the LPF 20 and LPF 40. In general, if the tensile strengths (both MD and CD) are increased, then more material is required resulting in a fabric that has a greater weight, a greater strength, and generally a greater cost. If the tensile strengths are less than approximately 10 Lbs. (using the ASTM D5034 2 inch test method), then the durability of the LPF is generally not acceptable for reusable protective covers. The moisture vapor transfer rate (MVTR) is a measure of passage of water vapor through a fabric and generally should be kept less than approximately 400 grams per square meter per 24 hours for this embodiment. In general if a fabric has a shrinkage ratio greater than approximately 3 to 5% the fabric would be considered unacceptable as a reusable protective cover.

Figure 2:
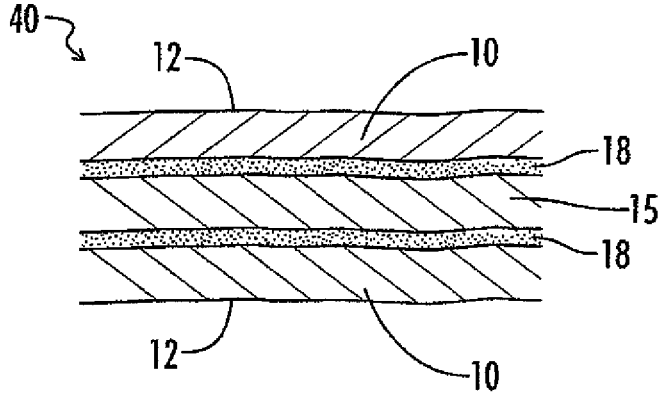
FIG. 2 depicts another exemplary embodiment of a layered polyolefin fabric for protective covers.

FIG. 2 depicts an embodiment of another LPF as a tri-laminate polyolefin fabric 40. A top layer 10 is a nonwoven polyolefin fabric, a middle layer 15 is a polyolefin film, and a bottom layer 10 is a nonwoven polyolefin fabric. The top fabric 12 is bonded to one side of the middle layer 15 and the bottom layer 12 is bonded to the other side of the middle layer 15. Bonding is provided by adhesive layers 18. The tri-laminate polyolefin fabric 40 has two nonwoven fabric surfaces 12. In another embodiment of a tri-laminate fabric, the middle layer 15 is a nonwoven polyolefin fabric and the top and bottom layers 12, are polyolefin films. The embodiments of the tri-laminate polyolefin fabric 40 may use a variety of materials and bonding techniques as described in U.S. Provisional Application No. 61/087,865, entitled "Non-Woven Fabrics for Bedding Applications," and filed on Aug. 11, 2008, which is incorporated herein by reference.

Embodiments of protective covers of the disclosure use the LPF 20 (a bi-laminate) or the LPF 40 (a tri-laminate). Other embodiments of a LPF have additional polyolefin layers and have layers of other materials. Nonwoven polyolefin fabrics and polyolefin films that are combined in laminated arrangements with other thermal plastics and bedding fabrics are possible.

Figure 3:
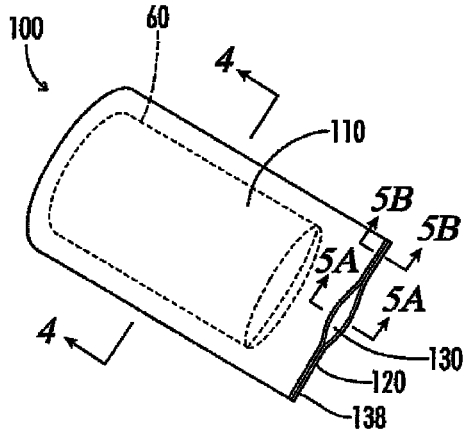
FIG. 3 depicts an exemplary embodiment of a protective cover for a pillow where the cover material is the fabric of FIG. 1.

FIG. 3 depicts an exemplary embodiment of a pillow protective cover 100 composed of panels of LPF, such as bi-laminate 20 of FIG. 1. In an alternative embodiment, the panels of LPF are composed of the tri-laminate 40 of FIG. 2.

Figure 4:
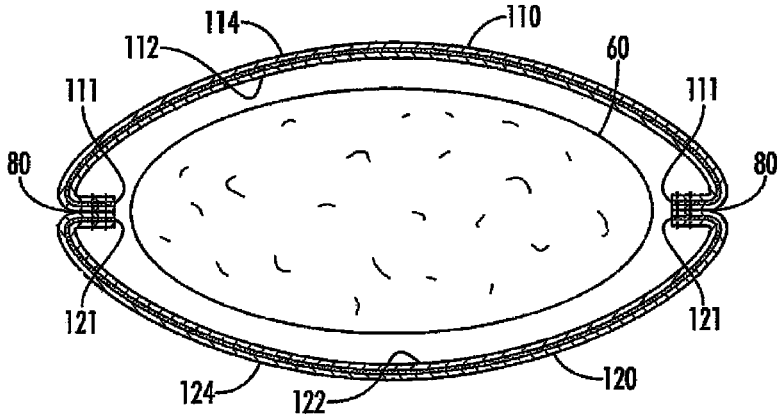
FIG. 4 depicts a cross-sectional view of the cover depicted by FIG. 3.
Figure 5A:
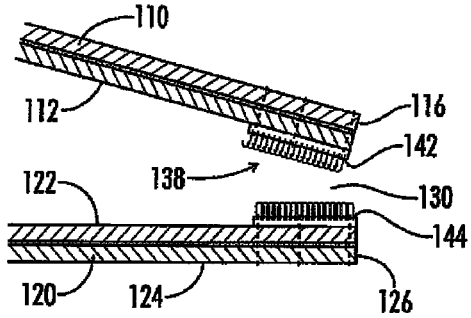
FIGS. 5A and 5B depict cross-sectional views of the cover depicted by FIG. 3.

Panels of other bedding fabrics combined with panels of LPF are possible in other embodiments. The pillow protective cover 100 is shown encasing a pillow 60 within a cavity formed by a top panel 110 and a bottom panel 120. The cavity is defined by an interior surface 112 of a top panel 110 and an interior surface 122 of a bottom panel 120 as best seen in FIG. 4. Each interior surface 112, 122 is a polyolefin film surface. At least one of the exterior surfaces 114, 124 of the pillow protective cover 100 is a nonwoven polyolefin fabric surface (the other exterior surface/panels could be of other known bedding materials). The panels are joined together about a portion of their circumferential edges 111, 121 using conventional fabrication techniques such as sewing as depicted by seam 80 in FIG. 4. An opening 130, defined by another portion of the edges, is provided for inserting the pillow 60 into the protective cover 100 or for removing the pillow 60 from the protective cover 100. Referring now to FIG. 5A, the portion of panel edges forming the opening 130 have an opening edge 116 on the top panel 110 and an opening edge 126 on the bottom panel 120. A first part of a closure 138 is joined the top opening edge 116 and a second part of the closure 138 is joined to the bottom opening edge 126. In one embodiment the closure 138 is hook and loop closure 138 and in another embodiment the closure is a zipper 150.

FIG. 5A depicts a hook and loop closure joined to the top panel 110 and the bottom panel 120. The hook and loop closure 138 comprises a hook fabric 142 and a loop fabric 144. The hook fabric 142 is joined, via sewing or pressure sensitive adhesive (psa), to the interior surface 112 of the top panel 110 near the edge of the opening 130. The loop fabric 144 is joined, via sewing or pressure sensitive adhesive (psa), to the interior surface 122 of the bottom panel 120 near the edge of the opening 130. When the hook fabric 142 is pressed snuggly against the loop fabric 144 along the entire length of the hook and loop closure 138, the opening is in closed position. The opening is placed in the open position when forces are applied to separate the hook fabric 142 from the loop fabric 144. Hook and loop closures 140 are often known as Velcro® fasteners.

Figure 5B:
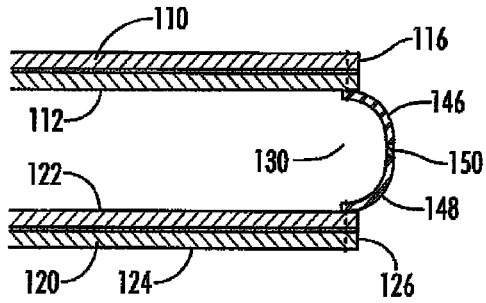

FIG. 5B depicts a zipper 150 joined to the top panel 110 and the bottom panel 120. The zipper 150 comprises a top zipper segment 146 and a bottom zipper segment 148. The top zipper segment 146 is joined, via sewing, to the interior surface 112 of the top panel 110 near the edge of the opening 130. The bottom zipper segment 148 is joined, via sewing, to the interior surface 122 of the bottom panel 120 near the edge of the opening 130. When a zipper tab (not shown) is fully pulled one way the zipper 150 is in a closed position and when the zipper tab is fully pulled the opposite way the zipper 150 is in an open position. A variety of zippers are available and well known to those in the bedding industries.

Figure 6:
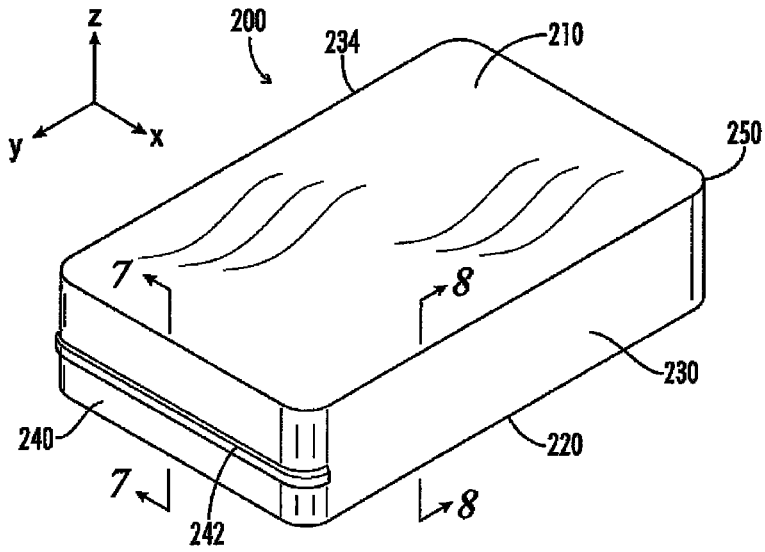
FIG. 6 depicts an exemplary embodiment of a protective cover for a mattress and/or box springs where the cover material is the fabric of FIG. 1.

FIG. 6 depicts an exemplary embodiment of a mattress protective cover 200. The mattress protective cover 200 is partly or wholly composed of LPF. In one embodiment the panels for the mattress cover 200 are composed of bi-laminate polyolefin fabric 20. For other embodiments, the panels are comprised of other LPFs joined with other knits, woven or nonwoven bedding fabrics.

Figure 7:
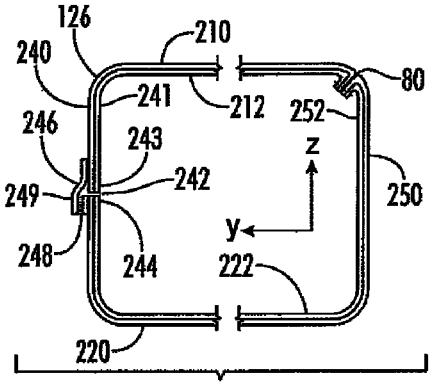
FIG. 7 depicts a cross-sectional view of the cover depicted by FIG. 6.
Figure 8:
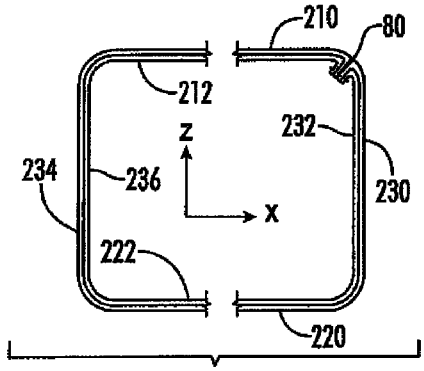
FIG. 8 depicts a cross-sectional view of the cover depicted by FIG. 6.

The mattress protective cover 200 has a top panel 210, a bottom panel 220, a foot panel 250, a head panel 240 and side panels 230, 234. A cavity for enclosing a mattress (not shown) is defined by the interior surfaces 212, 222, 252, 241, 232 and 236 of the respective panels as depicted in FIG. 6, FIG. 7 and FIG. 8. The edges of the panels are joined together (not specifically shown) using techniques well known to those in the bedding industry. For example, the panels of the mattress protective cover 200 may be joined together as depicted in FIG. 4 for the pillow protective cover forming the seam 80. In another embodiment the panels are a continuous fabric as shown by corner 126. In another embodiment the head panel 240, foot panel 250, and side panels 230, 234 are replaced by a single circumferential side panel that fits about the circumference of the mattress. The top panel 210 and bottom panel 220 are then joined together with the circumferential side panel.

In one embodiment, using bi-laminate fabric 20, the interior surface of each panel is a polyolefin film surface and each exterior surface of the mattress cover is a nonwoven polyolefin surface. In other embodiments, the interior surfaces and exterior surfaces of each panel are other polyolefin surfaces. In another embodiment, the mattress protective cover 200 has one or more panels composed of the tri-laminate polyolefin fabric 40. In still another embodiment the mattress protective cover is partly LPF 20 and/or LPF 40 sewn together with other known bedding materials (such as knits, woven fabrics or nonwoven fabrics).

An opening 242, for removing or inserting the mattress, is defined by a top edge 243 and bottom edge 244 of the head panel 240. In the embodiment depicted in FIG. 6, the opening 242 extends approximately the length of the head panel 240 as defined by traveling across the head panel in the x direction. In another embodiment, the opening 242 extends beyond the front panel along one or more of the side panels 230, 234.

A closure 249, depicted in FIG. 7, is used to seal the mattress within the cavity of the protective mattress cover 200. The closure 249 is attached to edges 243, 244 of the opening 242 and may be a loop and hook closure having a loop fabric 246 and a hook fabric 248 as shown in FIG. 7. Other closures for other embodiments include zippers, ziplock fasteners, snaps, hooks and eyes, pressure sensitive adhesive (psa) and closures known to those in the bedding industry. The opening 242 is in a closed position when portions of the closure are fully engaged, e.g., the zipper is zipped. FIG. 8 depicts a cross-sectional view of the cover of FIG. 6 and shows the orientation of the side panels 230, 234 with respect to the top panel 210 and the bottom panel 220. Protective covers, such as mattress protective cover 200, are formed by joining panels. Other protective covers comprising LPF could be manufactured as a unitary piece of fabric.

Figure 9:
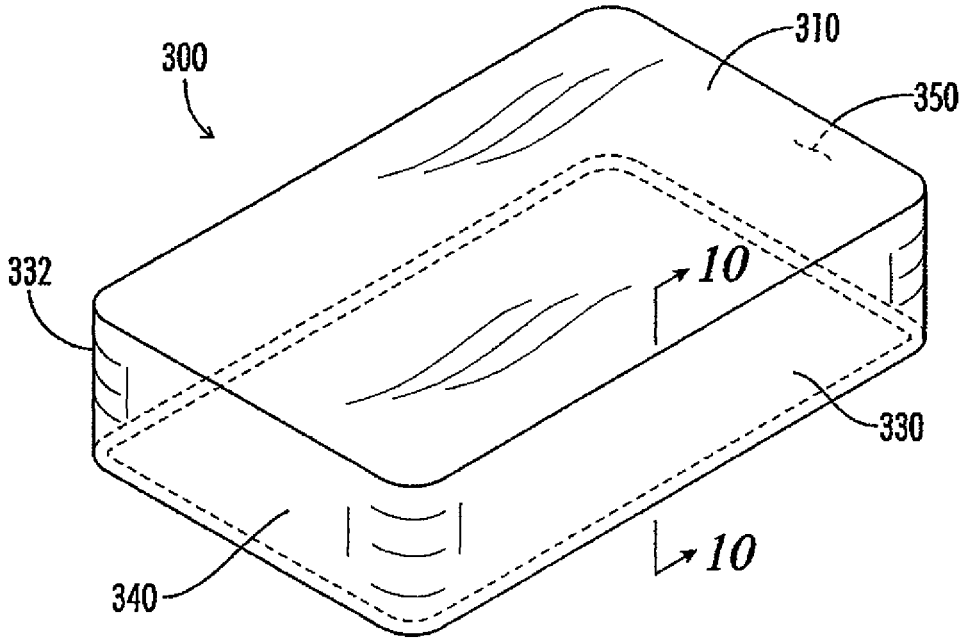
FIG. 9 depicts another exemplary embodiment of a protective cover for a mattress and/or box springs in accordance with the present disclosure

FIG. 9 depicts an exemplary embodiment of a mattress protective cover 300. The mattress protective cover 300 comprises a top panel 310 of LPF and other panels of LPF. The other panels for mattress protective cover 300 include a head panel 340, a foot panel 350, and side panels 330, 332 that are joined to the top panel 310. The panels are joined together using techniques well know to those in the bedding industry. The head, foot and side panels when joined together form a circumferential skirt that is adapted to cover the sides of the mattress when the cover 300 is installed. In another embodiment, the head panel 340, the foot panel 350 and the side panels 330, 332 are made of LPF's but the top panel 310 is made of conventional fabrics known to those in the bedding industry. In another embodiment of mattress protection panel 300 the head panel 340, foot panel 350, and side panels 330, 332 are replaced by a circumferential side panel that fits about the circumference of the mattress.

Figure 10:
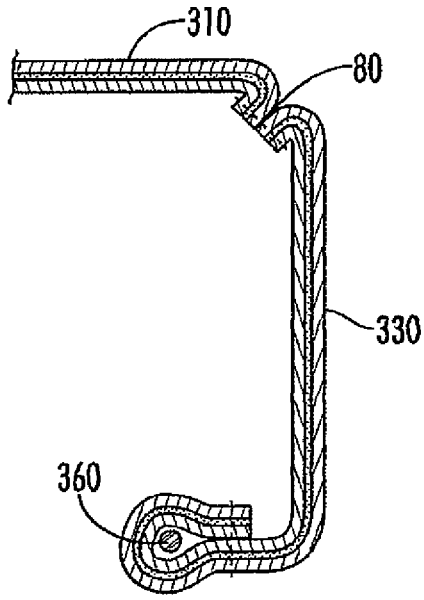
FIG. 10 is a cross-sectional view of the cover depicted by FIG. 9.

FIG. 10 depicts an elastic cord 360 sewn along the bottom edge of the head panel 340, foot panel 350 and side panels 332, 334. The elastic cord 360 is used to hold the mattress protective cover 300 to the mattress. In another embodiment the elastic cord is sewn in the corners of the circumferential skirt so as to fit to the mattress like a fitted sheet. Other methods, such as those known to those in the bedding industry, for holding the mattress protective cover to the mattress are used in other embodiments.

It should be emphasized that the above-described embodiments of the present disclosure are merely examples of implementations, set forth for a clear understanding of the principles of the disclosure. Many variations and modifications may be made to the above-described embodiments of the disclosure without departing substantially from the spirit and principles of the invention. All such modifications and variations are intended to be included herein within the scope of this disclosure and the present invention and protected by the following claims.

What is claimed is:

1. A protective cover for a bedding element comprising:

a first and second panels of layered polyolefin fabric (LPF) for preventing passage of dust mites through the protective cover, wherein the LPF has at least one nonwoven polypropylene fabric bonded to a film comprising polyethylene, polypropylene, or polyurethane, wherein the LPF has allergen barrier pore sizes less than 10 microns, and wherein the LPF has a moisture vapor transfer rate of less than 100 grams per square meter per 24 hours, and wherein the first panel and second panel are joined together forming a cavity for receiving the bedding element; and a sealable closure for sealing the cavity.

2. The cover of claim 1, wherein the LPF is a bi-laminate fabric.

3. The cover of claim 1, wherein the allergen barrier pore sizes are greater than 2 microns.

4. The cover of claim 1, wherein the LPF has a tensile strength of at least 10 pounds per two square inches.

5. The cover of claim 4, wherein the LPF has a basic weight of between 25 and 118 grams per square meter.

6. The cover of claim 1, wherein the first panel and the second panel are permanently joined.

7. The cover of claim 6, wherein the first panel and the second panel are permanently joined by sewing.

8. The cover of claim 6, wherein the first panel and the second panel are permanently joined by an adhesive.

9. The cover of claim 6, further comprising a third panel of bedding fabric permanently joined to and between the first and second panels, the third panel having a slit for receiving the bedding element.

10. The cover of claim 9, wherein the sealable closure is joined to the third panel along edges of the slit.

11. The cover of claim 9, further comprising:

a fourth panel of bedding fabric permanently joined to and between the first and second panels;

a fifth panel of bedding fabric permanently joined to and between the first and second panels, wherein the fifth panel is permanently joined to and between the third and fourth panels; and a sixth panel of bedding fabric permanently joined to and between the first and second panels, wherein the sixth panel is permanently joined to and between the third and fourth panels.

12. The cover of claim 11, wherein each of the second, third, fourth, fifth, and sixth panels comprise LPF.

13. A system comprising:

a bedding element; and the cover of claim 1.

14. A mattress protective cover comprising:

first and second panels of layered polyolefin fabric (LPF) for preventing passage of dust mites through the mattress protective cover, wherein the LPF has at least one nonwoven polypropylene fabric bonded to a film comprising polyethylene, polypropylene, or polyurethane, wherein the LPF has allergen barrier pore sizes less than 10 microns, and wherein the LPF has a moisture vapor transfer rate of less than 100 grams per square meter per 24 hours; and wherein the second panel is joined to the first panel, and wherein the mattress protective cover encases the mattress in a sealed cavity thereby providing a barrier to dust mites surrounding the mattress.

* * * * *